US009896790B2

(12) United States Patent
Ko

(10) Patent No.: US 9,896,790 B2
(45) Date of Patent: Feb. 20, 2018

(54) ELASTIC FABRIC WITH VENTILATION EFFECT

(71) Applicant: Lin-Ming Ko, Changhua (TW)

(72) Inventor: Lin-Ming Ko, Changhua (TW)

(73) Assignee: K. S. Webbing Co. Ltd., Changhua (TW)

( * ) Notice: Subject to any disclaimer, the term of this patent is extended or adjusted under 35 U.S.C. 154(b) by 0 days.

(21) Appl. No.: 15/296,437

(22) Filed: Oct. 18, 2016

(65) Prior Publication Data

US 2017/0145608 A1 May 25, 2017

(30) Foreign Application Priority Data

Nov. 19, 2015 (TW) ..... 104138297 A

(51) Int. Cl.

| | |
|---|---|
| ***D03D 15/08*** | (2006.01) |
| ***D04B 21/18*** | (2006.01) |
| ***D03D 19/00*** | (2006.01) |
| ***D04B 21/10*** | (2006.01) |
| ***D04C 1/08*** | (2006.01) |
| *D03D 7/00* | (2006.01) |

(52) U.S. Cl.

CPC ..... *D04B 21/18* (2013.01); *D03D 19/00* (2013.01); *D04B 21/10* (2013.01); *D04C 1/08* (2013.01); *D03D 2700/0103* (2013.01)

(58) Field of Classification Search

CPC ..... D03D 15/08; D03D 2700/0103; D03D 19/00; D03D 7/00; D03D 9/00; D04B 1/18; D04B 21/18; D04B 1/104; D04B 21/10; D04B 21/12; D04B 21/14; D04B 39/06; Y10T 442/3024; Y10T 442/413; Y10T 442/3008

See application file for complete search history.

(56) References Cited

U.S. PATENT DOCUMENTS

| | | | | | |
|---|---|---|---|---|---|
| 1,914,148 | A | * | 6/1933 | Meagher | D03D 15/08 112/475.01 |
| 1,929,006 | A | * | 10/1933 | Snader | A41B 11/00 2/240 |
| 1,973,594 | A | * | 9/1934 | Wolf | A42B 1/22 2/183 |
| 2,032,265 | A | * | 2/1936 | Dawes | D04C 1/00 87/2 |
| 2,048,294 | A | * | 7/1936 | Roberts | A43C 11/002 36/55 |

(Continued)

*Primary Examiner* — Bobby Muromoto, Jr.

(74) *Attorney, Agent, or Firm* — Che-Yang Chen; Law Offices of Scott Warmuth

(57) ABSTRACT

An elastic fabric made by a plurality of rubber threads, first elastic wefts, second elastic wefts, first wraps, high-tensile nylons and second wraps. The rubber thread, the first elastic weft, the second elastic weft are elastic, and the first elastic weft, and the second elastic weft are knitted across and interlaced with the rubber thread at right angles such that the elastic fabric is configured to be stretched in all directions. The first elastic weft and the second elastic weft are wrapped on at least three rubber threads to form a plurality of breathing holes therebetween, and the first wrap and the second wrap are wrapped along the single rubber thread such that the elastic fabric is configured to have the solid structure and the great ventilation effect simultaneously.

6 Claims, 4 Drawing Sheets

(56) References Cited

U.S. PATENT DOCUMENTS 2,120,665 A * 6/1938 Crimmins ..... A41C 1/06 450/131
2,153,645 A * 4/1939 Schonfeld ..... D04B 21/18 66/192
2,186,531 A * 1/1940 Kendrick ..... D02G 3/32 139/421
2,188,241 A * 1/1940 Davis ..... D04B 1/26 66/172 E
2,230,402 A * 2/1941 Getaz ..... D04B 9/54 66/172 E
2,286,171 A * 6/1942 Krasnov ..... A47C 31/11 297/224
2,297,028 A * 9/1942 Sheeler ..... D04B 1/26 66/110
2,332,848 A * 10/1943 Grabec ..... A41D 31/00 156/148
2,536,163 A * 1/1951 Feild, Jr. ..... D04B 1/00 28/155
2,628,928 A * 2/1953 Cadous ..... B32B 3/266 156/123
2,723,587 A * 11/1955 Wheatcroft ..... D04C 5/04 87/2
2,852,834 A * 9/1958 Engelhard ..... D02G 3/328 28/155
2,960,855 A * 11/1960 Siciliano ..... D04B 21/18 450/156
3,016,726 A * 1/1962 Lawson ..... A41C 1/02 66/177
3,141,318 A * 7/1964 Griffith ..... A41C 1/003 66/177
4,813,459 A * 3/1989 Breidegam ..... A61N 1/14 139/420 C
6,477,865 B1 * 11/2002 Matsumoto ..... D04B 21/02 66/195
8,012,893 B1 * 9/2011 Liebe ..... D03D 15/08 428/317.3
8,419,135 B2 * 4/2013 Moeseneder ..... B60N 2/5816 297/440.11
9,028,461 B2 * 5/2015 Kobayashi ..... A61F 13/15699 604/385.24
9,615,975 B2 * 4/2017 Rastegar ..... A61F 13/0233
2002/0098759 A1 * 7/2002 Salway ..... D03D 9/00 442/200
2002/0157429 A1 * 10/2002 Matsumoto ..... D04B 35/04 66/121
2004/0112508 A1 * 6/2004 Umebayashi ..... A61F 13/15593 156/160
2015/0209171 A1 * 7/2015 Stier ..... D04B 21/12 602/19
2016/0038083 A1 * 2/2016 Ding ..... A61B 5/6804 600/388
2017/0121869 A1 * 5/2017 Cheng ..... D03D 7/00

* cited by examiner

ELASTIC FABRIC WITH VENTILATION EFFECT

FIELD OF THE INVENTION

The present invention relates to an elastic fabric, and more particularly to an elastic fabric with reliable ventilation and attaching effects.

BACKGROUND OF THE INVENTION

Generally, a convention elastic fabric has at least a section of hairy loops which are configured to be repeatably attached by a plurality of tiny hooks on a piece of a fastener thus achieving attaching effect. Referring to FIG. 4, the elastic fabric (20) is made and knitted by a plurality of elastic pieces (21), upper wefts (22), lower wefts (23), wraps (24), nylon threads (25) and cotton threads (26). The upper wefts (22) and the lower wefts (23) are respectively coupled with the elastic pieces (21) at an upper surface and a lower surface thereof to form an interleaving pattern. Along each of the elastic pieces, each of the wraps (24) is interlaced at an intersection between the upper wefts (22) and elastic piece (21) and between the lower wefts (23) and the elastic piece (21), and the nylon thread (25) wound between the elastic piece (21) and the wrap (24) is spanned through the upper wefts (22) and the lower wefts (23) to form a plurality of hairy loops (251). Then, a flat surface of the elastic fabric (20) is made through repeatedly weaving the cotton threads (26) between the elastic pieces (21) and both of the upper wefts (22) and the lower wefts (23), and positions of the flat surface of the elastic fabric (20) with the hairy loops (251) and without the hairy loops (251) arranged in alternating pattern are respectively formed into attaching areas (201) and breathing areas (202) thereby improving the ventilation and comfort of the elastic fabric (20).

However, the conventional elastic fabric has following disadvantages: although the elastic fabric (20) comprises a plurality of breathing holes thereon, however, because of the conditional weaving method, only parts of breathing holes which are located on the breathing areas (202) take effect. As a result, the attaching areas (201) which are lack in cooling and ventilation effect may cause a user to appear allergic symptoms such as itching and eczema. Therefore, there remains a need for a new and improved design for an elastic fabric with ventilation effect to overcome the problems presented above.

SUMMARY OF THE INVENTION

The present invention provides an elastic fabric which is knitted and made by a plurality of rubber threads, first elastic wefts, second elastic wefts, first wraps, high-tensile nylons and second wraps. The rubber threads are arranged parallel with each other, and the first wrap and the second wrap are respectively wound on and across the rubber thread. At least three rubber threads as a first group are wrapped by the first elastic weft and the second elastic weft, and the first elastic weft and the second elastic weft are configured to respectively wrap across an upper surface and a lower surface of the rubber thread. The weaving process is to repeat an S-shaped and inverted S-shaped pattern till the first elastic weft and the second elastic weft reach the second ends of the rubber threads. More specifically, the first elastic weft and the second elastic weft are configured to wrap across a middle rubber thread first and toward a first adjacent rubber thread at one side of the middle rubber thread. After crossing the first adjacent rubber thread, the first elastic weft and the second elastic weft go back and cross the first adjacent rubber thread, the middle rubber thread and a second adjacent rubber thread at another side of the middle rubber thread, and then go back to cross the second adjacent rubber thread and the middle rubber thread to complete the S-shaped weaving pattern. Then, an inverted S-shaped weaving pattern comes after the S-shaped weaving pattern, the first elastic weft and the second elastic weft are configured to start from an opposed direction to wrap across the middle rubber thread toward the second adjacent rubber thread first, and cross the three rubber threads, and then go back and cross the first adjacent rubber thread and the middle rubber thread to complete the inverted S-shaped pattern. Thus, each of the breathing holes is formed at a gap between a lower portion of the S-shaped weaving and an upper portion of the inverted S-shaped weaving. Furthermore, when the elastic fabric has more than three rubber threads, the second adjacent rubber thread of the first group is served as a first adjacent rubber thread of a second group to keep and extend the weaving pattern. A plurality of junctions are formed at contacting points between the first elastic weft and the rubber thread and between the second elastic weft and the rubber thread. Each of the first wraps made of fabric material such as nylon, charcoal yarn, or cotton yarn is configured to be knitted and arranged under a single rubber thread in an alternate pattern of L-shaped and reversed L-shaped to form a bottom surface of the elastic fabric. More specifically, a first arm of the L-shaped parallel and located at a first lateral side of the rubber thread spans the two junctions, and a second arm thereof passes through an underside of the rubber thread to a second lateral side of the rubber thread, and then starts the reversed L-shaped in the same way that a first arm of the reversed L-shaped parallel and located at the second lateral side of the rubber thread spans the two junctions, and a second arm thereof passes through the underside of the rubber thread to the first lateral side of the rubber thread to complete an unit of the alternate pattern. Each of the high-tensile nylons arranged along the rubber thread is sequentially wrapped on the rubber thread, the first elastic weft, the second elastic weft to form a top surface of the elastic fabric, and a plurality of hairy loops formed thereon are separated by the same interval. Furthermore, each of the hairy loops horizontally spans four junctions, and each of the high-tensile nylons has a plurality of fixing knots at the junctions between the rubber thread and the first elastic weft and between the rubber thread and the second elastic weft. Moreover, each of the second wraps arranged along the rubber thread comprises a plurality of knot points which are respectively knitted at the junctions and configured to tightly secure positions of the rubber thread, the first elastic weft, the second elastic weft, the first wrap and the high-tensile nylon to form the elastic fabric.

The rubber thread, the first elastic weft and the second elastic weft are elastic, and the first elastic weft, and the second elastic weft are knitted across and interlaced with the rubber thread at right angles such that the elastic fabric is configured to be stretched in all directions. The first elastic weft and the second elastic weft are wrapped on at least three rubber threads to form the breathing holes therebetween, and the first wrap and the second wrap are wrapped along the single rubber thread. As a result, the elastic fabric is configured to have the solid structure and the great ventilation effect simultaneously.

The first wraps and the high-tensile nylons are respectively wrapped below and above the rubber threads, first elastic wefts, and the second elastic wefts to form the bottom surface and the top surface of the elastic fabric, and the high-tensile nylon further comprises the hairy loops to be attached by a piece of tiny hooks thus achieving the fixing effect and improving the practicability of the elastic fabric.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
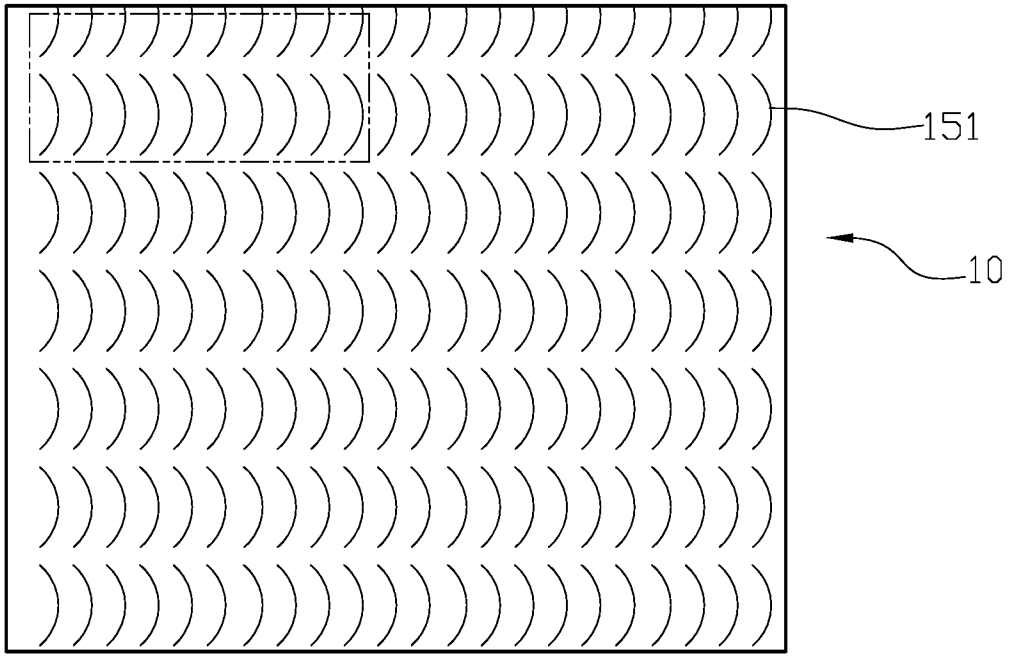
FIG. 1 is a plane view of an elastic fabric in the present invention.
Figure 2:
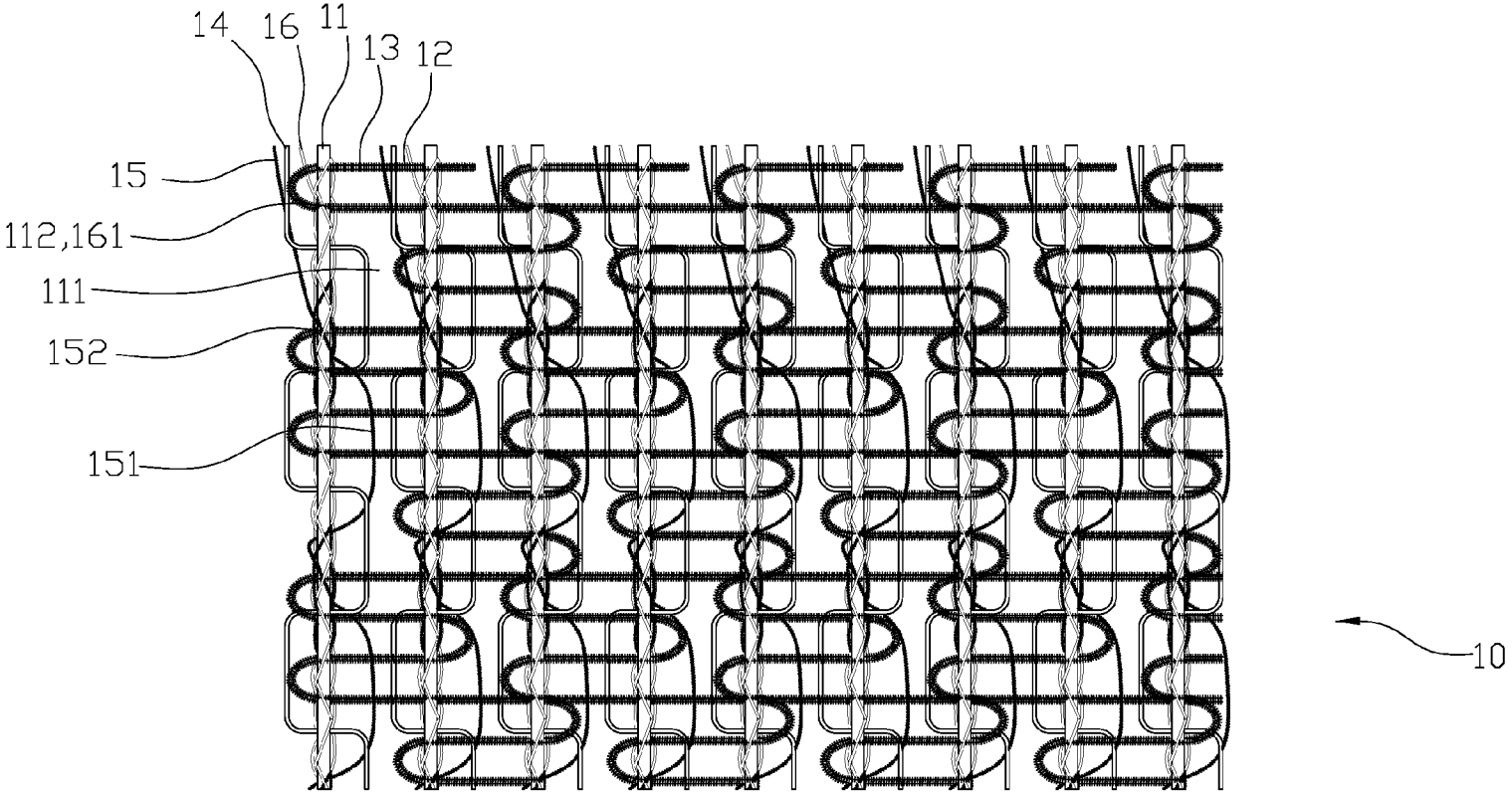
FIG. 2 is a partial enlarged view of the elastic fabric in the present invention.
Figure 3:
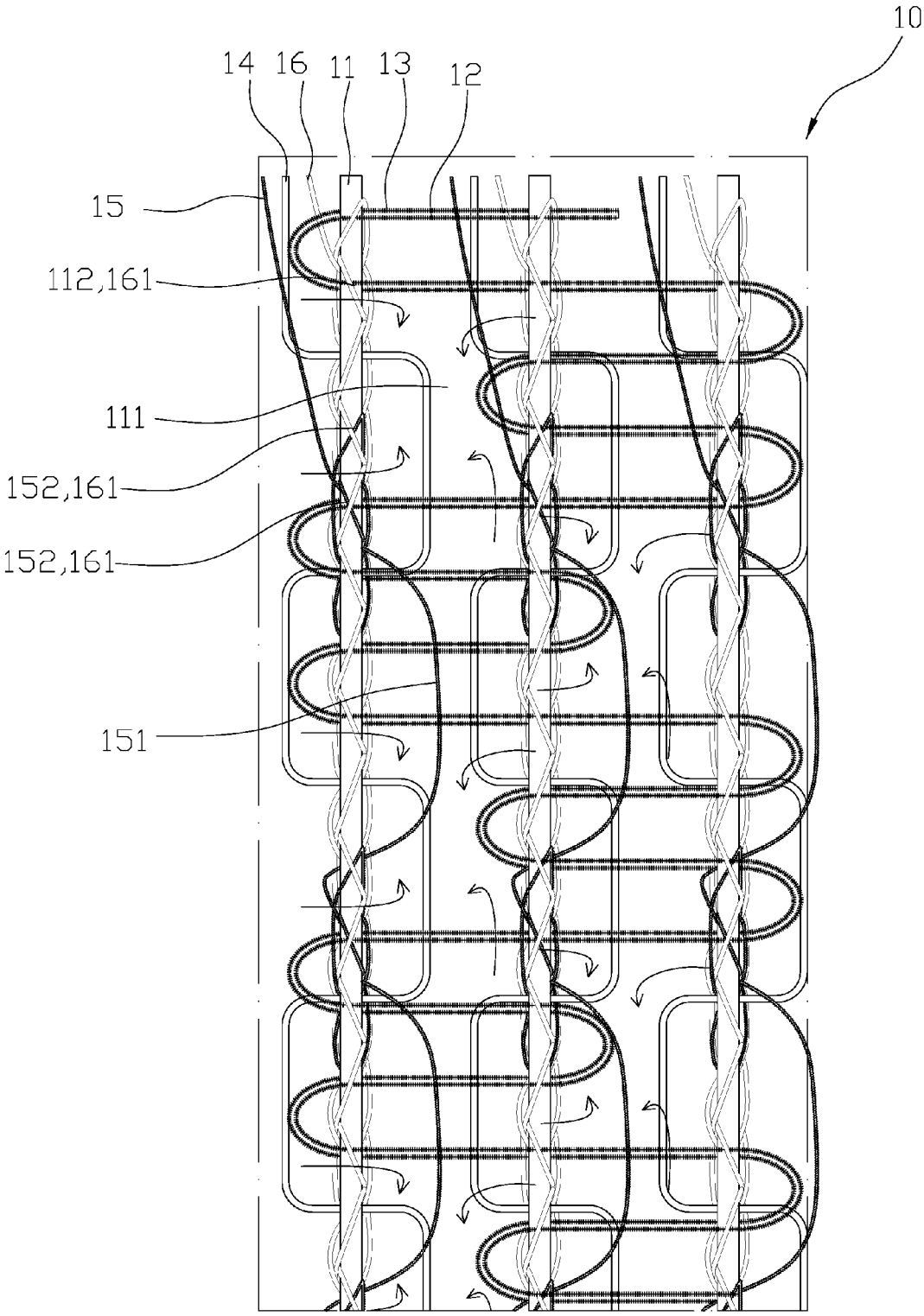
FIG. 3 is a partial enlarged view illustrating a single unit of the elastic fabric in the present invention.
Figure 4:
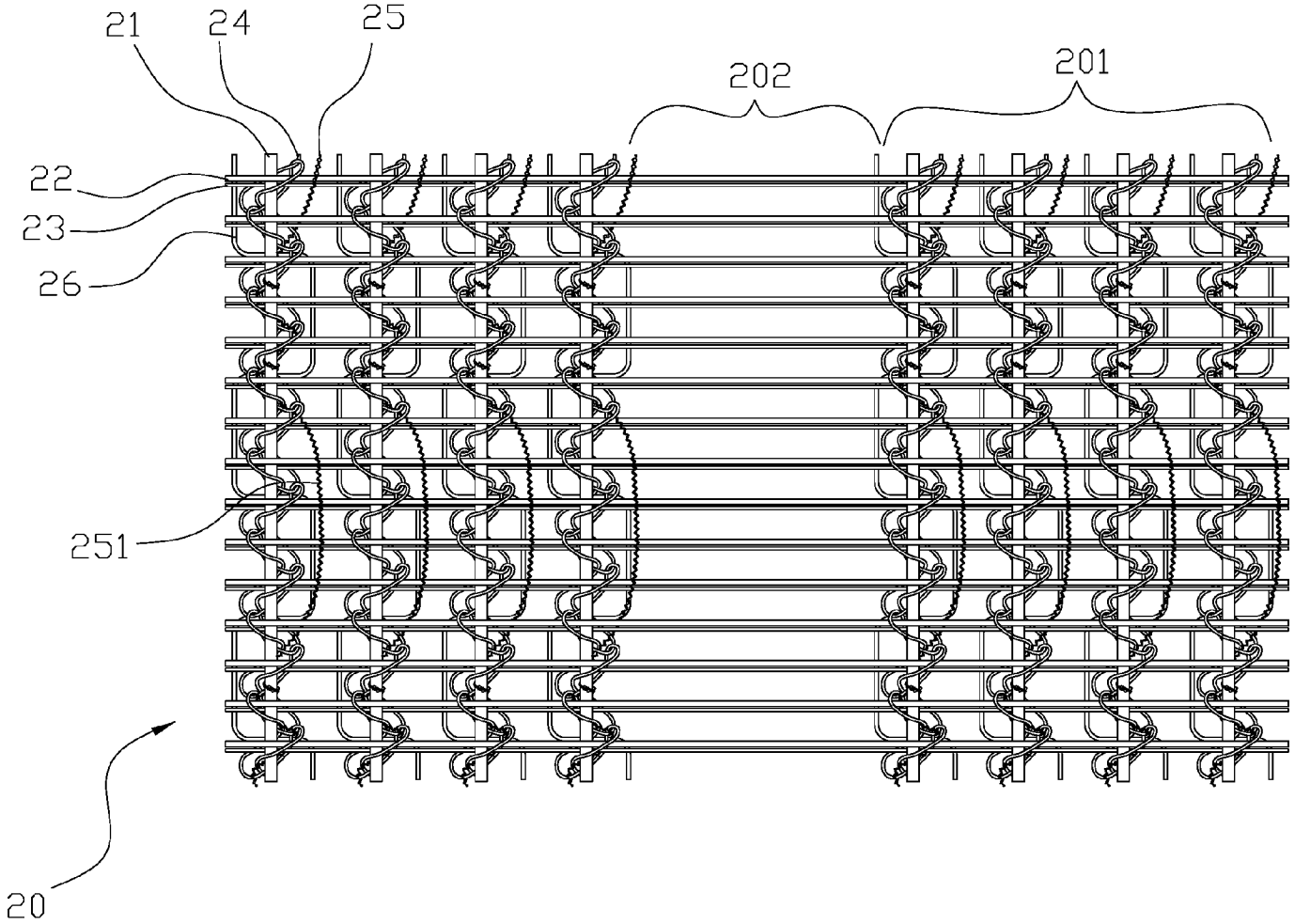
FIG. 4 PRIOR ART
FIG. 4 is a prior art.

In order to further understand the goal, characteristics and effect of the present invention, a number of embodiments along with the drawings are illustrated as following:

Referring to FIGS. 1 to 3, the present invention provides an elastic fabric (10) which is knitted and made by a plurality of rubber threads (11), first elastic wefts (12), second elastic wefts (13), first wraps (14), high-tensile nylons (15) and second wraps (16). The rubber threads (11) are arranged parallel with each other, and the first wrap (14) and the second wrap (16) are respectively wound on and across the rubber thread (11). At least three rubber threads (11) as a first group are wrapped by the first elastic weft (12) and the second elastic weft (13), and the first elastic weft (12) and the second elastic weft (13) are configured to respectively wrap across an upper surface and a lower surface of the rubber thread (11). The weaving process is to repeat an S-shaped and inverted S-shaped pattern till the first elastic weft (12) and the second elastic weft (13) reach the second ends of the rubber threads (11). More specifically, the first elastic weft (12) and the second elastic weft (13) are configured to wrap across a middle rubber thread (11) first and toward a first adjacent rubber thread (11) at one side of the middle rubber thread (11). After crossing the first adjacent rubber thread (11), the first elastic weft (12) and the second elastic weft (13) go back and cross the first adjacent rubber thread (11), the middle rubber thread (11) and a second adjacent rubber thread (11) at another side of the middle rubber thread (11), and then go back to cross the second adjacent rubber thread (11) and the middle rubber thread (11) to complete the S-shaped weaving pattern. Then, an inverted S-shaped weaving pattern comes after the S-shaped weaving pattern, the first elastic weft (12) and the second elastic weft (13) are configured to start from an opposed direction to wrap across the middle rubber thread (11) toward the second adjacent rubber thread (11) first, and cross the three rubber threads (11), and then go back and cross the first adjacent rubber thread (11) and the middle rubber thread (11) to complete the inverted S-shaped pattern. Thus, each of the breathing holes (111) is formed at a gap between a lower portion of the S-shaped weaving and an upper portion of the inverted S-shaped weaving. Furthermore, when the elastic fabric (10) has more than three rubber threads (11), the second adjacent rubber thread of the first group is served as a first adjacent rubber thread of a second group to keep and extend the weaving pattern. A plurality of junctions (112) are formed at contacting points between the first elastic weft (12) and the rubber thread (11) and between the second elastic weft (13) and the rubber thread (11). Each of the first wraps (14) made of fabric material such as nylon, charcoal yarn, or cotton yarn is configured to be knitted and arranged under a single rubber thread (11) in an alternate pattern of L-shaped and reversed L-shaped to form a bottom surface of the elastic fabric (10). More specifically, a first arm of the L-shaped parallel and located at a first lateral side of the rubber thread (11) spans the two junctions (112), and a second arm thereof passes through an underside of the rubber thread (11) to a second lateral side of the rubber thread (11), and then starts the reversed L-shaped in the same way that a first arm of the reversed L-shaped parallel and located at the second lateral side of the rubber thread (11) spans the two junctions (112), and a second arm thereof passes through the underside of the rubber thread (11) to the first lateral side of the rubber thread (11) to complete an unit of the alternate pattern. Each of the high-tensile nylons (15) arranged along the rubber thread (11) is sequentially wrapped on the rubber thread (11), the first elastic weft (12), the second elastic weft (13) to form a top surface of the elastic fabric (10), and a plurality of hairy loops (151) formed thereon are separated by the same interval. Furthermore, each of the hairy loops (151) horizontally spans four junctions (112), and each of the high-tensile nylons (15) has a plurality of fixing knots (152) at the junctions (112) between the rubber thread (11) and the first elastic weft (12) and between the rubber thread (11) and the second elastic weft (13). Moreover, each of the second wraps (16) arranged along the rubber thread (11) comprises a plurality of knot points (161) which are respectively knitted at the junctions (112) and configured to tightly secure positions of the rubber thread (11), the first elastic weft (12), the second elastic weft (13), the first wrap (14) and the high-tensile nylon (15) to form the elastic fabric (10).

In actual application, referring to FIGS. 2 and 3, the rubber thread (11), the first elastic weft (12) and the second elastic weft (13) are elastic, and the first elastic weft (12), and the second elastic weft (13) are knitted across and interlaced with the rubber thread (11) at right angles such that the elastic fabric (10) is configured to be stretched in all directions. The first elastic weft (12) and the second elastic weft (13) are wrapped on at least three rubber threads (11)

to form the breathing holes (111) therebetween, and the first wrap (14) and the second wrap (16) are wrapped along the single rubber thread (11). As a result, the elastic fabric (10) is configured to have the solid structure and the great ventilation effect simultaneously.

In addition, the first wraps (14) and the high-tensile nylons (15) are respectively wrapped below and above the rubber threads (11), first elastic wefts (12), and the second elastic wefts (13) to form the bottom surface and the top surface of the elastic fabric (10), and the high-tensile nylon (15) further comprises the hairy loops (151) to be attached by a piece of tiny hooks thus achieving the fixing effect and improving the practicability of the elastic fabric (10).

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. An elastic fabric knitted and made by a plurality of rubber threads, first elastic wefts, second elastic wefts, first wraps, high-tensile nylons, and second wraps;

wherein the rubber threads are arranged parallel with each other, and the first wrap and the second wrap are respectively wrapped on and across the rubber thread; at least three rubber threads as a first group are wrapped by the first elastic weft and the second elastic weft, and the first elastic weft and the second elastic weft are configured to wrap across an upper surface and a lower surface of the rubber thread respectively; wherein a weaving process is to repeat an S-shaped and inverted S-shaped pattern along a direction of the rubber thread, and the first elastic weft and the second elastic weft are configured to wrap across a middle rubber thread first and toward and across a first adjacent rubber thread at one side of the middle rubber thread, and go back to sequentially wrap across the first adjacent rubber thread, the middle rubber thread and a second adjacent rubber thread at another side of the middle rubber thread, and then go back to wrap across the second adjacent rubber thread and the middle rubber thread to complete the S-shaped weaving pattern; the inverted S-shaped weaving pattern comes after the S-shaped weaving pattern that the first elastic weft and the second elastic weft are configured to start from an opposed direction to wrap across the middle rubber thread toward and across the second adjacent rubber thread first, and sequentially wrap across the three rubber threads, and then go back to wrap across the first adjacent rubber thread and the middle rubber thread to complete the inverted S-shaped pattern such that each of the breathing holes is formed at a gap between the S-shaped and the inverted S-shaped weaving pattern, and a plurality of junctions are formed at contacting points between the first elastic weft and the rubber thread and between the second elastic weft and the rubber thread; wherein when the elastic fabric has more than three rubber threads, the second adjacent rubber thread of the first group is served as a first adjacent rubber thread of a second group to keep and extend the weaving pattern; each of the first wraps arranged along the rubber thread is knitted under and crossed between two lateral sides of the rubber thread in a bit stream pattern with the same interval to form a bottom surface of the elastic fabric; each of the high-tensile nylons arranged along the rubber thread is sequentially wrapped on the rubber thread, the first elastic weft, and the second elastic weft to form a top surface of the elastic fabric, and a plurality of hairy loops formed thereon respectively span with the same interval; each of the second wraps arranged along the rubber thread comprises a plurality of knot points which are respectively knitted at the junctions and configured to tightly secure positions of the rubber thread, the first elastic weft, the second elastic weft, the first wrap and the high-tensile nylon to form the elastic fabric.

2. The elastic fabric of claim 1, wherein the first wraps are made of fabric material such as nylon, charcoal yarn, or cotton yarn.

3. The elastic fabric of claim 2, wherein each of the first wraps arranged along the rubber thread is knitted under and crossed between the two lateral sides of the rubber thread in the bit stream pattern with the same interval, and each of the intervals horizontally spans two junctions.

4. The elastic fabric of claim 1, wherein each of the hairy loops horizontally spans four junctions, and each of the high-tensile nylons has a plurality of fixing knots knitted at the junctions between the rubber thread and the first elastic weft and between the rubber thread and the second elastic weft.

5. The elastic fabric of claim 2, wherein each of the hairy loops horizontally spans four junctions, and each of the high-tensile nylons has a plurality of fixing knots knitted at the junctions between the rubber thread and the first elastic weft and between the rubber thread and the second elastic weft.

6. The elastic fabric of claim 3, wherein each of the hairy loops horizontally spans four junctions, and each of the high-tensile nylons has a plurality of fixing knots knitted at the junctions between the rubber thread and the first elastic weft and between the rubber thread and the second elastic weft.

* * * * *